US005657501A

United States Patent [19]

Refai

[11] Patent Number: 5,657,501

[45] Date of Patent: Aug. 19, 1997

[54] METHOD FOR THE INTENSIFICATION OF WASHING PROCESSES

[76] Inventor: Muhammed Refai, Esserstrasse 5, 50354 Huerth, Germany

[21] Appl. No.: 515,468

[22] Filed: Aug. 15, 1995

[30] Foreign Application Priority Data

Aug. 19, 1994 [DE] Germany ..... 44 29 579

[51] Int. Cl.[6] ..... D06F 39/00

[52] U.S. Cl. ..... 8/158; 8/159

[58] Field of Search ..... 134/7; 8/158, 159; 68/13 R, 29, 17 R

[56] References Cited

U.S. PATENT DOCUMENTS 4,051,046 9/1977 Diehl et al. .

4,804,488 2/1989 Alvemarker .

FOREIGN PATENT DOCUMENTS 3740764 9/1989 Germany .

91-217590/30 2/1991 Japan .

*Primary Examiner*—Philip R. Coe

*Attorney, Agent, or Firm*—Hill, Steadman & Simpson

[57] ABSTRACT

In a method for intensifying a washing process by use of a contact material to be added thereto, a noticeable improvement of the cleaning effect is achieved both when washing textiles as well as when rinsing dishes upon saving of cleaning agent, reduced water consumption and reduced volume and degree of contamination of waste water in that at least one polycarbonate body is employed as contact body and this body undergoes the washing process together with the goods to be washed.

28 Claims, No Drawings

METHOD FOR THE INTENSIFICATION OF WASHING PROCESSES

BACKGROUND OF THE INVENTION

The invention is directed to a method for the intensification of washing processes by means of a contact material.

Numerous combinations of washing-active cleaning agents that are soluble in wash water and contain soap or do not contain soap are known. Included, for example, are also surface-active cleaning agents without soap that have a component comprising at least one carbonate, for example carboxylic acids or their salts. Over and above this, numerous other organic or inorganic compounds are known as cleaning or washing agents, particularly soaps of fatty acid condensation products. A disadvantage shared by all washing-active cleaning agents soluble in wash water is that they must be relatively highly dosed in order to achieve a satisfactory cleanliness of textile wash or dishes. A suds whose residues must be rinsed off from the washed goods by extremely intensive and multiply repeated rinsing procedures thereby arises, a high water consumption and a correspondingly high volume of waste water being caused thereby. Over and above this, suds residues produce an ugly gray veil in washed textiles and deposit as lime or carbonate encrustations at parts of washing machines, mainly at heating rods, and are the cause of greater damage at such parts. When cleaning or rinsing dishes, suds residues that are difficult to rinse off likewise cause a type of gray veil that is considered ugly, especially on glassware, and makes a manual re-cleaning necessary. All of these disadvantages not only lead to undesirably high costs when washing, as well as to environmental pollution, but also to added work in the household.

It has also turned out in practice that the effect of commercially obtainable cleaning agents differs greatly and that some attack both textiles as well as the skin.

SUMMARY OF THE INVENTION

The invention is based on the object of specifying a method for gentle intensification of a washing process with a contact material to be added to the washed goods, for example, textiles or dishes, and that in interaction with standard cleaning agents, noticeably intensifies their cleaning power, as a result whereof the required quantity thereof is substantially reduced. Water consumption and volume of waste water are significantly diminished at the same time and that thus leads overall to preservation of the washed goods, protection of the skin, reduction of the harmful lime/carbonate agglomerations at washing machines and to reduced environmental pollution.

In method of the species initially cited, the stated object is inventively achieved in that at least one polycarbonate body is employed as a contact material and this undergoes the washing process together with the goods to be washed or, respectively, rinsed.

DETAILED DESCRIPTION OF THE PREFERRED EMBODIMENT

A number of advantages are surprisingly achieved with great advantage by employing a polycarbonate body as a contact material. These are:

- savings of up to 90% of the amount of cleaning agent previously required for washed goods. Given low water hardness, less than 10% of the previous amount of washing agent is required for 30° C. wash;

- noticeable reduction of environmental pollution as a result of reducing the chemical load of the waste water;
- optimization of the carbonate hardness, overall hardness and of the Ph value of the wash water, as well as water correspondingly higher in oxygen content as a result thereof;
- relaxation of the water surface with modification of the adhesion and cohesion forces, advantageous softness of the wash as a result, potentially without or with a reduced quantity of fabric softener;
- lower washing agent concentration in the suds, gray veil is reduced, consequently more intense colors and brighter white of the wash, luminous shine of washed dishes, reduced amount of rinse water and waste water;
- less shedding of wool textiles; less lint builds up in the wash machine lint screen;
- lime deposits in the washing machine are reduced and lower additives of deliming agents are required.

In manual dishwashing, the addition of a few drops of liquid cleaning or, respectively rinsing agent into the water suffices, whereby fewer residues of these agents remain on the dishes, for which reason manual follow-up can be eliminated; no scouring agents are required for cleaning the sink, the hands and the skin remain soft and do not become puffy given longer washing and rinsing.

Up to a 90% saving of flushing agent derives in dishwashing given employment of an automatic dishwasher. Advantages shared by manual and machine dishwashing are noticeable shine on flatware and dishes as well as clearly improved cleaning effect as a result of relaxation of the water surface. Cost reduction as well as environmental acceptability of the waste water are other clear advantages over previous washing and rinsing processes.

A development of the method provides that the washing or rinsing process is implemented with liquid which, in addition to containing water, contains only extremely slight parts of cleaning or, respectively, flushing agent and, potentially, little water softener and/or relaxant, and to which polycarbonates in solid form as a thermoplastic material are added as contact bodies.

Advantageously, the polycarbonate bodies remain unaltered in effect even given repeated use, i.e. they exhibit no wear phenomena.

Arbitrary shapes, for example cylinders, disks, cubes, prisms, cuboids, polyhedrons, balls, spherical sections, ellipsoids, hollow bodies or the like can be employed as contact bodies, preferably disk-shaped cylinders having a diameter of about 5 cm and a thickness of 1 cm.

Since the effect of the contact material is of a surface-active nature, there is a relationship between the active surface of the contact bodies available overall and their effect. Consequently, a preferred development of the invention provides that an aggregate of small bodies, balls, pearls, fragments, etc., are employed in a liquid-permeable packaging as contact bodies. As a result of this measure, the active surface can be nearly arbitrarily multiplied in a known way compared to one or a few larger bodies having the same mass. It can also be provided that fibers or foils of polycarbonate material are employed as contact bodies.

With the afore-mentioned measures, it is expedient that the size of the active surface of the polycarbonate material required for achieving a planned contact effect is dimensioned according to the criterion of the volume of cleaning fluid as well as the amount and/or weight of washed goods, how dirty they are and/or the cleaning agent concentration in the suds.

Further, the active surface and/or quantity of the polycarbonate material can be dimensioned based on the criterion of the carbonate hardness, overall hardness and Ph value of the water.

And, finally, the employment of at least one contact body of polycarbonate material in the wash water serves the purpose of gentle intensification of the washing power of a cleaning liquid that contains water and cleaning agent.

The inventive measures and developments thereof are not limited to the described exemplary embodiments. Possible modifications of the inventive method can be provided such that other, equivalent materials are employed instead of polycarbonate, are also employed in other workpiece shapes, whereby there is a dependency on the surface area, especially as a function of the amount of water and the degree of turbulence. The respective design embodiment in adaptation to specific applications is at the discretion of a person skilled in the art.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A method for intensifying a washing process for a wash load by means of a contact material to be added to the wash load, comprising the steps of employing polycarbonate material in the form of at least three polycarbonate bodies as contact material and introducing said contact material with the wash load to be washed or, respectively, rinsed.

2. A method according to claim 1, wherein the washing process is implemented with a liquid that, in addition to containing water, contains a minimal amount of cleaning agent and to which said contact polycarbonate contact bodies, in the form of thermoplastic material, are added.

3. A method according to claim 2, wherein said wash liquid contains a water softener or relaxant.

4. A method according to claim 3, wherein said contact bodies comprise a plurality of disk-shaped cylinders each having a diameter of about 5 cm and a thickness of 1 cm.

5. A method according to claim 2, wherein a size of an active surface of said polycarbonate material required in order to achieve a planned contact effect is dimensioned based on a criterion from the group consisting of a volume of a cleaning fluid, an amount and/or weight of the wash load, a level of dirtiness of the wash load or a cleaning agent concentration in the wash liquid.

6. A method according to claim 5, wherein the size of the active surface or the quantity of the polycarbonate material is dimensioned based on the criterion of carbonate hardness, overall water hardness and Ph value of the water.

7. A method according to claim 1, wherein at least one of said contact bodies is formed in at least one of the shapes comprising a cylinder, a disk, a cube, a prism, a cuboid, a polyhedron, a ball, a spherical segment, an ellipsoid, and a hollow member.

8. A method according to claim 1, wherein an aggregate of small bodies, balls, pearls, or fragments, in a liquid-permeable packaging is employed as said contact bodies.

9. A method according to claim 1, wherein fibers or foils of polycarbonate material are employed as said contact bodies.

10. A method for intensifying a washing process for a wash load by means of a contact material to be added to wash water for the load, comprising the steps of employing at least two separate contact bodies of polycarbonate material and introducing said contact bodies into the wash water for intensifying a washing power of a cleaning fluid that contains water and a cleaning agent.

11. A method according to claim 10, wherein said contact bodies are formed in at least one of the shapes comprising a cylinder, a disk, a cube, a prism, a cuboid, a polyhedron, a ball, a spherical segment, an ellipsoid, and a hollow member.

12. A method according to claim 11, wherein said contact bodies comprise a plurality of disk-shaped cylinders each having a diameter of about 5 cm and a thickness of 1 cm.

13. A method according to claim 11, wherein a size of an active surface of said polycarbonate material required in order to achieve a planned contact effect is dimensioned based on a criterion from the group consisting of a volume of the cleaning fluid, on an amount and/or weight of the wash load, a level of dirtiness of the wash load or a cleaning agent concentration in the wash liquid.

14. A method according to claim 13, wherein the size of the active surface or the quantity of the polycarbonate material is dimensioned based on the criterion of carbonate hardness, overall water hardness and Ph value of the water.

15. A method according to claim 10, wherein an aggregate of small bodies, bails, pearls, or fragments, in a liquid-permeable packaging is employed as said contact bodies.

16. A method according to claim 10, wherein fibers or foils of polycarbonate material are employed as said contact bodies.

17. A method for intensifying the washing process for a wash load by means of a contact material to be added to the wash load, comprising the steps of providing a plurality of solid polycarbonate material bodies and introducing said bodies into the wash load to be washed.

18. A method according to claim 17, wherein said solid polycarbonate bodies are formed in at least one of the shapes selected from the group consisting of a cylinder, a disk, a cube, a prism, a cuboid, a polyhedron, a ball, a spherical segment and an ellipsoid.

19. A method according to claim 17, wherein said polycarbonate bodies comprise a plurality of disk-shaped cylinders each having a diameter of about 5 cm. and a thickness of about 1 cm.

20. A method according to claim 17, wherein said polycarbonate bodies comprise an aggregate of fragments held in a liquid-permeable packaging to be introduced into the wash load.

21. A method according to claim 17, wherein said polycarbonate bodies comprise fibers.

22. A method according to claim 17, wherein said polycarbonate bodies comprise foils.

23. A method for intensifying the washing process for a wash load by means of a contact material to be added to the wash load, comprising the steps of providing at least one polycarbonate material body consisting solely of polycarbonate material and introducing said body into the wash load to be washed.

24. A method according to claim 23, wherein said at least one polycarbonate body is formed in at least one of the shapes selected from the group consisting of a cylinder, a disk, a cube, a prism, a cuboid, a polyhedron, a ball, a spherical segment and an ellipsoid.

25. A method according to claim 23, wherein said at least one polycarbonate body comprises a plurality of disk-shaped cylinders each having a diameter of about 5 cm. and a thickness of about 1 cm.

26. A method according to claim 23, wherein said at least one polycarbonate body comprises an aggregate of fragments held in a liquid-permeable packaging to be introduced into the wash load.

27. A method according to claim 23, wherein said at least one polycarbonate body comprises fibers.

28. A method according to claim 23, wherein said at least one polycarbonate body comprises foils.

* * * * *